US006501350B2

(12) United States Patent
Lester

(10) Patent No.: US 6,501,350 B2
(45) Date of Patent: Dec. 31, 2002

(54) FLAT RADIATING CABLE

(75) Inventor: Michael E. Lester, Burton, OH (US)

(73) Assignee: Electrolock, Inc., Hiram, OH (US)

( * ) Notice: Subject to any disclaimer, the term of this patent is extended or adjusted under 35 U.S.C. 154(b) by 0 days.

(21) Appl. No.: 09/818,442

(22) Filed: Mar. 27, 2001

(65) Prior Publication Data

US 2002/0140531 A1 Oct. 3, 2002

(51) Int. Cl.[7] ..... H01Q 13/20

(52) U.S. Cl. ..... 333/237; 343/770; 333/239; 333/241

(58) Field of Search ..... 333/237, 239, 333/241; 343/770, 771; 174/117 F, 117 FF, 110 N, 110 PM, 110 F

(56) References Cited

U.S. PATENT DOCUMENTS 2,800,634 A 7/1957 Greig et al.
3,587,098 A 6/1971 Gosnell
3,890,615 A 6/1975 Moran
4,063,246 A 12/1977 Greiser
4,701,765 A 10/1987 Arduini et al.
4,804,965 A 2/1989 Roederer
4,963,891 A 10/1990 Aoyagi et al.
5,068,632 A 11/1991 Champeau
5,155,493 A 10/1992 Thursby et al.
5,355,143 A 10/1994 Zürcher et al.
5,744,756 A * 4/1998 Springer et al. ..... 174/110 N
5,767,806 A 6/1998 Watanabe et al.
5,847,324 A * 12/1998 Farquhar et al. ..... 174/117 FF
6,081,728 A 6/2000 Stein et al.
6,087,996 A 6/2000 Dery

* cited by examiner

*Primary Examiner*—Michael Tokar
*Assistant Examiner*—Anh Q. Tran
(74) *Attorney, Agent, or Firm*—Pearne & Gordon LLP

(57) ABSTRACT

A flat radiating cable in which conductive layers are not adhered to a dielectric core. Each of the conductive layers comprises a resilient material which resists kinking and is capable of longitudinal translation with respect to the core and/or the other conductive layer.

19 Claims, 4 Drawing Sheets

FLAT RADIATING CABLE

FIELD OF THE INVENTION

The present invention relates generally to the field of radiating cables and more specifically to a flat, flexible radiating cable used as a transmitting and/or receiving antenna.

BACKGROUND OF THE INVENTION

Radiating or "leaky" cables are well known in the art of radio transceivers. Flat radiating cables are also known. They are an alternative to coaxial radiating cables and especially well suited for certain applications where a low profile is desirable. Further, they are generally inexpensive to manufacture do to their simple construction.

Examples of flat radiating cables are disclosed in U.S. Pat. No. 2,800,634 to Grieg et al. and U.S. Pat. No. 6,081,728 to Stein et al. These prior art flat radiating cables all suffer from a common weakness. Such cables generally include a flexible dielectric core laminated between and adhered to two conductive layers, such as the flat cable 50 shown in FIG. 1.

A typical material which is used for the conductive layers is a metallic foil, such as copper. However, as illustrated in FIG. 2, when the cable 50 is flexed, kinks 52 may develop in the foil. This kinking effect is due, at least in part, to the differences in longitudinal compressibility between the various materials employed in the cable 50. Such kinks 52 have the adverse effect of significantly limiting the frequency response of the cable 50 at higher frequencies.

There is an increasing use of higher frequency transmission, such as in wireless data transmission. Thus, it would be desirable to provide a flat radiating cable for high frequency radio transmission and/or reception that is not prone to the frequency limiting kinks described above.

BRIEF SUMMARY OF THE INVENTION

According to the present invention, a radiating cable is provided. The cable comprises a first layer comprising conductive material, a second layer comprising conductive material, and a dielectric layer being positioned between and adjacent to both the first layer and the second layer. At least one of the first layer and the second layer comprises a resilient material. Further, at least one of the first layer, the second layer, and the dielectric layer is movable relative to the other layers.

DETAILED DESCRIPTION OF THE INVENTION

The term "flat" as used herein refers to a cable having a generally flattened appearance. Further, the term "conductive" as used herein refers to the ability of a material to actively comprise an antenna and/or a waveguide, to the extent that it is capable of generating, carrying, radiating and/or receiving electromagnetic radiation.

The terms "active" and "ground" as they are used herein have been selected as being convenient labels since they relate to the use of the present invention in a specific embodiment. However, the terms "active" and "ground" are not intended to serve as functional limitations, since the invention as contemplated has a wide variety of potential uses and possible embodiments.

Figure 1:
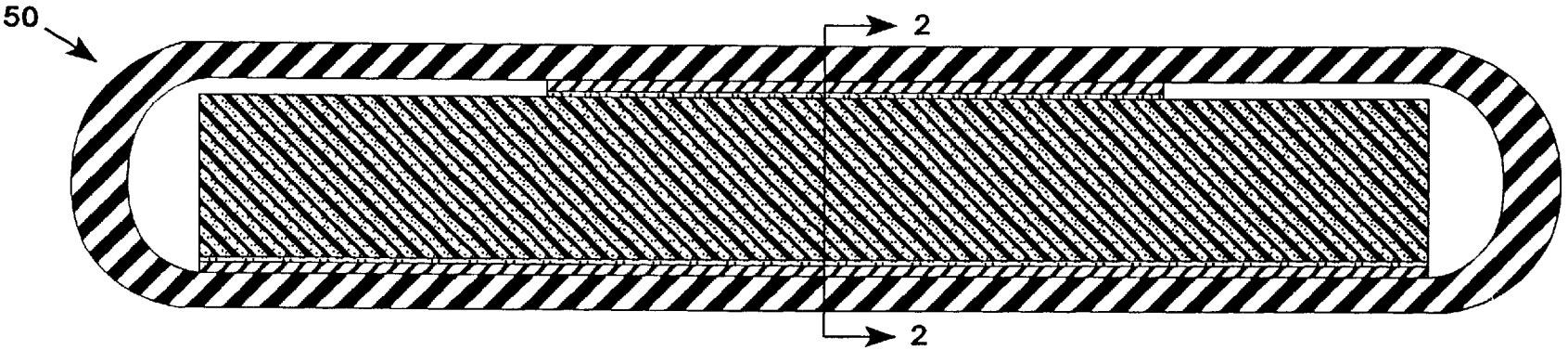
PRIOR ART FIG. 1
FIG. 1 is a sectional view of a prior art flat radiating cable.
Figure 4:
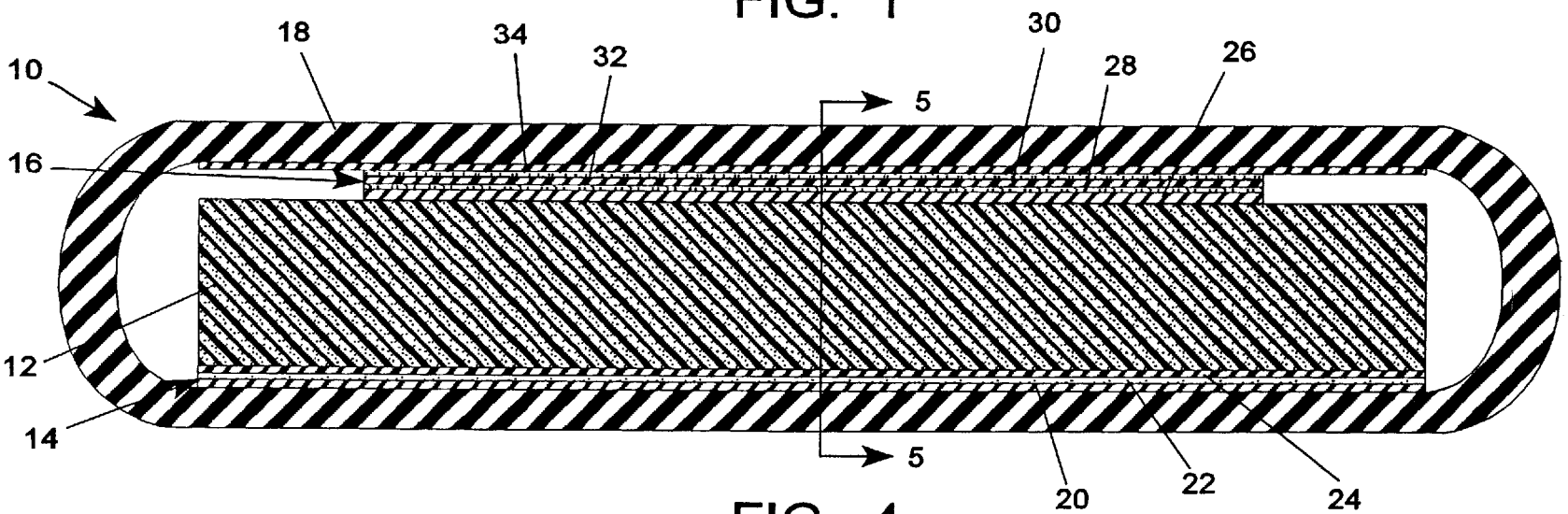
FIG. 4 is a sectional view of a flat radiating cable according to the present invention taken along section line 4—4 of FIG. 3.
Figure 5:
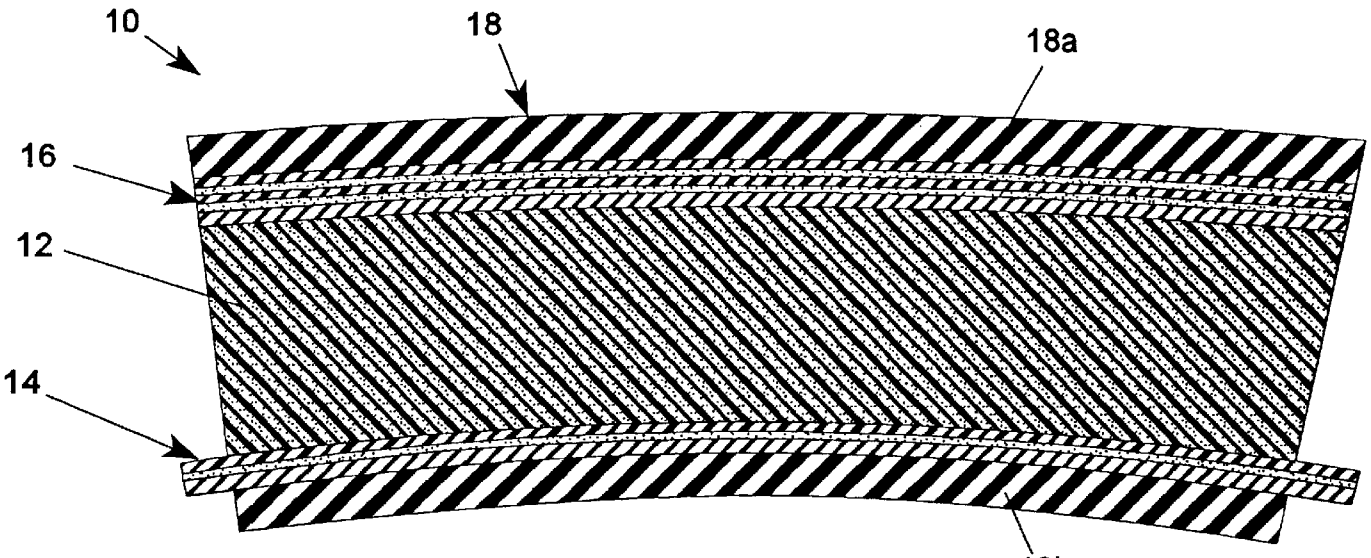
FIG. 5 is a section view of a flat radiating cable according to the present invention taken along section line 5—5 of FIG. 4.
Figure 3:
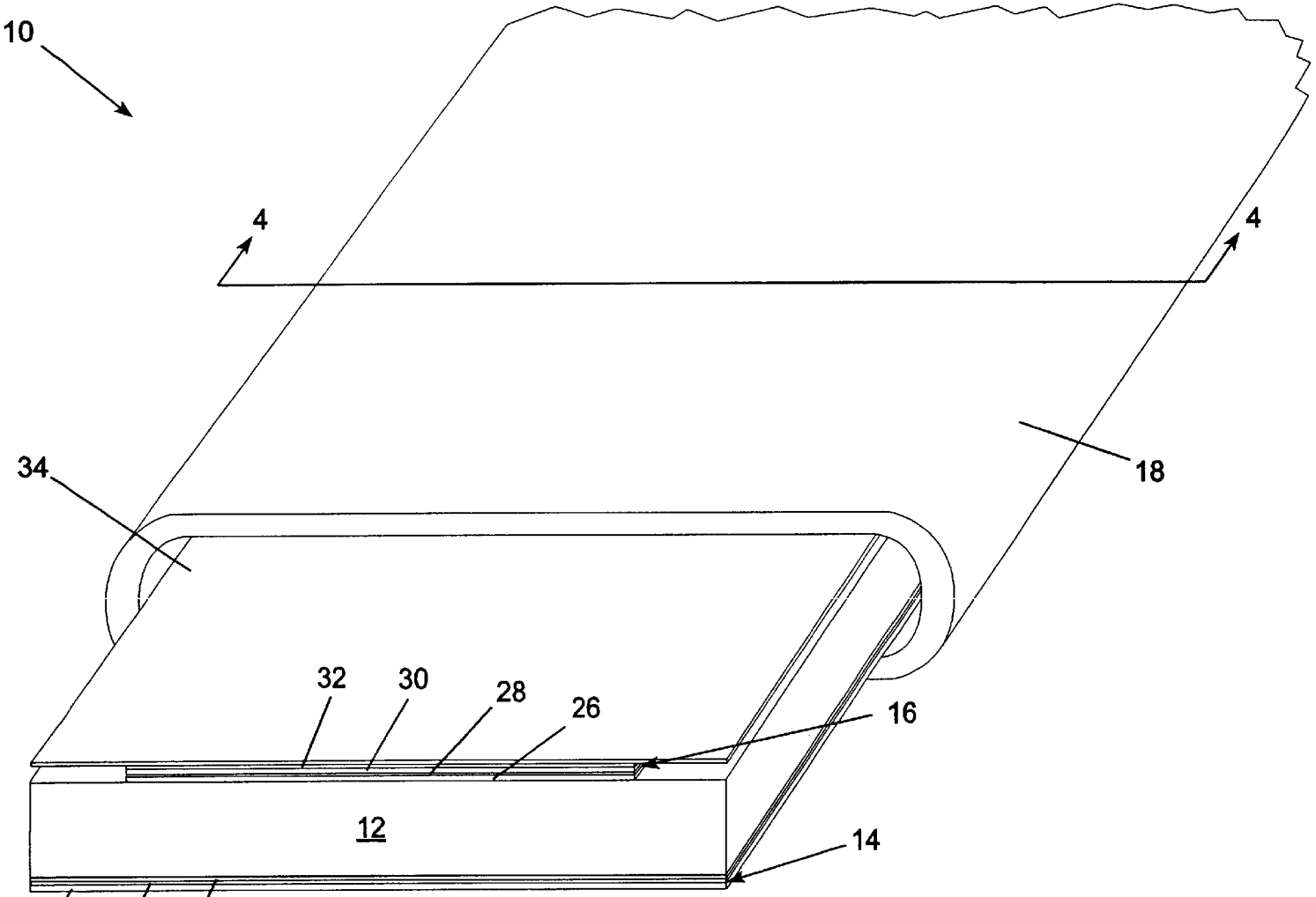
FIG. 3 is a perspective view of a portion of a flat radiating cable according to the present invention, shown with an insulating sheath partially removed.

FIGS. 3–5 show an embodiment of a flat radiating cable 10 according to the present invention. Generally, the cable 10 is arranged as a laminate, including a dielectric core lamina or layer 12 positioned between a conductive ground lamina or layer 14 and a conductive active lamina or layer 16. Each of conductive layers 14 and 16 is adjacent to the core layer 12. Adjacent layers make contact with one another for substantially their entire length, except to any extent that one layer is longer than another.

An insulating sheath 18 surrounds the layers 12, 14 and 16. The sheath 18 may be made of any of various materials known in the art to be suitable for providing insulation and protection, to improve external appearance, and to facilitate handling of conductors, such as polyvinyl chloride (PVC).

The layers 12, 14 and 16, as well as the sheath 18, are flexible to allow the cable to be routed through a building, or the like, along walls, ceilings, or other structures, and to be conveniently secured thereto. The layers 12, 14 and 16 are adapted to be moveable, in a longitudinal direction relative to one another, within the sheath 18. Further, each of the conductive layers 14 and 16 include a resilient material which helps to resist the plastic deformation of that layer 12, 14 or 16. Examples of providing such resilient materials are described below.

Figure 2:
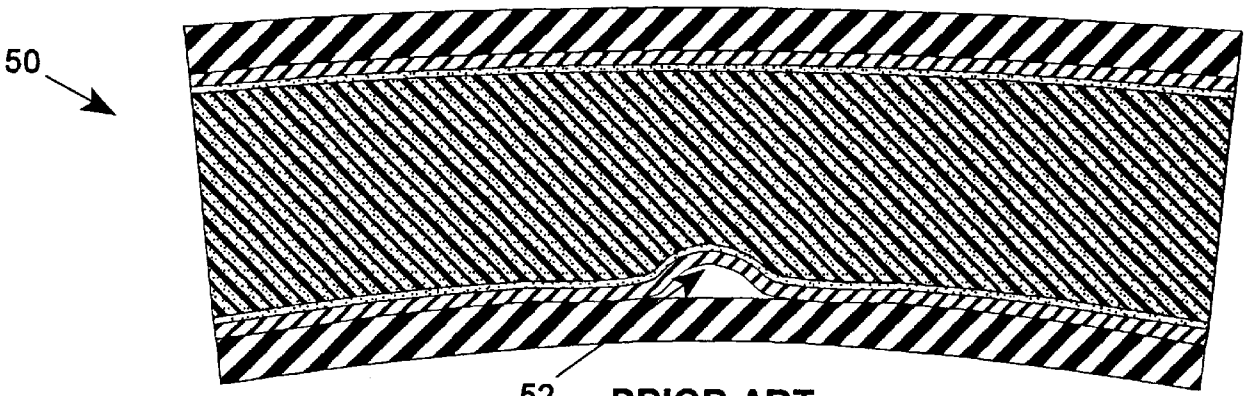
PRIOR ART FIG. 2
FIG. 2 is a section view of a prior art flat radiating cable taken along section line 2—2 of FIG. 1.

In use, the cable 10 may be bent, as shown by FIG. 5, in order to accommodate the contours of the structure to which it may be secured. When the cable 10 is bent, one or more of the layers may shift with respect to the others. As a result, the conductive layers 14 and 16 of the cable 10 are able to resist the kinking 52 that is characteristic of the prior art cables 50 (FIG. 2).

FIG. 5 illustrates the resistance of kinking in the present invention by way of example. In this example, the cable 10 is bent so that a top side 18*a* of the sheath 18 tends to elongate while a bottom side 18*b* of the sheath 18 tends to longitudinally compress. The ground layer 14 and the active layer 16 are incapable of substantial elastic elongation or longitudinal compression. However, as a result of the above-described construction of the cable 10, the bending of the cable 10 will tend to result in relative longitudinal movement between the layers 12, 14 and 16 and the sheath 18, rather than plastic deformation.

As mentioned above, each of the conductive layers 14 and 16 include resilient materials. In the present embodiment, as shown in FIGS. 3–5, each of the ground layer 14 and the active layer 16 comprises sub-layers to provide resilience. The dielectric core layer 12 of the present embodiment comprises a cross-linked polyethylene foam. However, any suitably insulating and flexible material could be used.

As shown, the ground layer 14 can be made from a stock laminate including a conductive strip 20, such as copper foil, secured by a dry adhesive layer 22 to a resilient strip 24, such as polyester (PET) film. Other materials having suitable properties, as described above, could be used in place of the copper foil and PET film.

As shown, the active layer 16 may include a stock laminate similar in composition to that described above with regard to the ground layer 14. In this case, the active layer 16 includes a conductive strip 26 secured by a dry adhesive layer 28 to a resilient PET strip 30. In some cases, such as in the present embodiment, the conductive portion 26 of the active layer 16 is provided being narrower than the ground layer 14. Since the active layer 16 is constructed from stock material, each of the layers 26, 28, 30 will have this narrower width. Therefore, to help prevent lateral shifting of the active layer 16 with respect to the rest of the cable 10, a PET carrier strip 34 is provided. Specifically, the carrier strip 34 is approximately the same width as the ground layer 14 and/or the core 12 and is secured to the resilient strip 30 of the active layer 16, such as by using a pressure sensitive adhesive 32. The active layer 16, as well as the other layers 12 and 14, will have a width which is slightly smaller than the inside width of the sheath 18. The result is that each of the layers 12, 14 and 16, being constrained by the sheath 18, will not significantly laterally shift relative to one another.

Although the ground layer 14 and the active layer 16 in the described embodiment comprise specific sub-layers to provide desired characteristics, it should be appreciated that suitable alterative are contemplated to be within the scope of the present invention. Such alternatives include, but are not limited to, the use of conductive polymer film, nonconductive film printed with conductive ink, or metal foil of a resilient alloy. It is contemplated to be within the scope of the invention, as an alternative to the disclosed embodiment, to construct a ground layer and/or an active layer each comprising a single layer and having no sub-layers. Adding additional layers and/or sub-layers is also contemplated to be within the scope of the invention.

Figure 6:
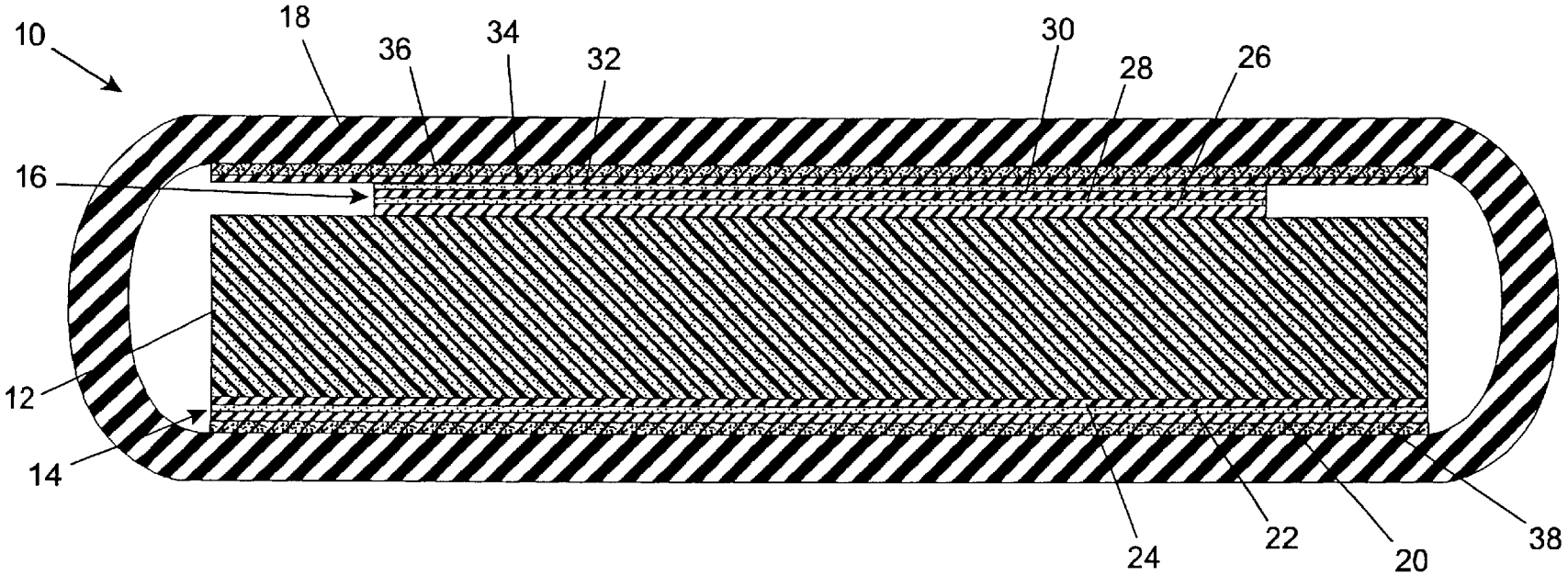
FIG. 6 is a section view of a flat radiating cable according to an alternate embodiment of the present invention.

FIG. 6 shows an alternative embodiment of the present invention in which slip layers 36, 38 are provided to help prevent the layers 14, 16 from unintentionally adhering or "sticking" to the sheath 18. As shown, the first slip layer 36 is positioned adjacent the conductive layer 16, between the conductive layer 16 and the sheath 18. The second slip layer 38 is positioned adjacent the ground layer 14, between the ground layer 14 and the sheath 18. The slip layers 36, 38 can be any material that is compatible with the material used in the adjacent layers, such that it helps to prevent sticking. An example of a suitable material for the slip layers 36, 38 in this embodiment is a commercially available non-woven fabric, 650 microns thick, composed of natural and synthetic fibers, including cellulose, rayon, and other synthetic materials.

Further, while the invention has been described with reference to specific embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed for carrying out this invention, but that the invention will include all embodiments falling within the scope of the appended claims.

What is claimed is:

1. A radiating cable, comprising:

a first layer comprising conductive material;

a second layer comprising conductive material; and a dielectric layer being positioned between and adjacent to both the first layer and the second layer;

wherein at least one of the first layer and the second layer comprises a resilient material; and wherein at least one of the first layer, the second layer, and the dielectric layer is movable relative to the other layers.

2. The radiating cable of claim 1, further comprising a flexible sheath at least partially enclosing the second layer.

3. A radiating cable, comprising:

a first layer comprising conductive material;

a second layer comprising conductive material;

a dielectric layer being positioned between and adjacent to both the first layer and the second layer;

a flexible sheath at least partially enclosing the second layer;

at least one slip layer, the slip layer being positioned adjacent to one of the first layer and the second layer and the slip layer is positioned adjacent to the flexible sheath wherein at least one of the first layer and the second layer comprises a resilient material; and wherein at least one of the first layer, the second layer, and the dielectric layer is movable relative to the other layers.

4. The radiating cable of claim 3, wherein the slip layer comprises a non-woven fabric.

5. The radiating cable of claim 1, wherein at least one of the first layer and the second layer comprises a strip comprising the resilient material and wherein the resilient material is conductive.

6. The radiating cable of claim 1, wherein at least one of the first layer and the second layer comprises a first strip comprising the conductive material and being secured to a second strip comprising the resilient material.

7. The radiating cable of claim 6, wherein the conductive strip is secured to the resilient strip by an adhesive layer.

8. The radiating cable of claim 6, wherein the conductive strip comprises copper.

9. The radiating cable of claim 6, wherein the resilient strip comprises polyester.

10. The radiating cable of claim 1, wherein at least one of the second layer and the first layer comprises a conductive polymer.

11. The radiating cable of claim 1, wherein at least one of the second layer and the first layer comprises conductive ink.

12. The radiating cable of claim 1, wherein at least one of the second layer and the first layer comprises a resilient metal alloy.

13. A radiating cable, comprising:

a plurality of layers, each of the layers being positioned adjacent to one or two other layers; and a flexible sheath at least partially enclosing the plurality of layers;

wherein at least one of the layers is capable of movement relative to at least one other of the layers;

wherein at least one of the layers comprises a resilient material; and wherein at least one of the layers comprises a conductive material.

14. A radiating cable, comprising:

an elongated core having a lateral cross section being generally rectangular;

a first elongated layer positioned adjacent a first side of the core, the first elongated layer comprising:

a first conductive sub-layer comprising metallic foil; and a first resilient sub-layer adhered to the first conductive sub-layer;

a second elongated conductive layer positioned adjacent a second side of the core, the second conductive layer comprising:

a second conductive sub-layer comprising metallic foil;

a second resilient sub-layer adhered to the second conductive sub-layer; and a carrier strip adhered to one of the second conductive sub-layer and the second resilient sub-layer;

a sheath surrounding the first conductive layer, the second conductive layer and the carrier strip a first slip layer positioned between and adjacent to both the first elongated layer and the sheath; and a second slip layer positioned between and adjacent to both the second elongated layer and the sheath.

15. The radiating cable of claim 14, wherein the elongated core comprises foam.

16. The radiating cable of claim 14, wherein at least one of the first resilient sub-layer, the second resilient sub-layer and the carrier strip comprises polyester.

17. The radiating cable of claim 14, wherein at least one of the first conductive sub-layer and the second conductive sub-layer comprises copper foil.

18. The radiating cable of claim 14, wherein the sheath comprises vinyl.

19. The radiating cable of claim 14, wherein the first and second slip layers each comprise non-woven fabric.

* * * * *